US009679680B1

(12) United States Patent
Cohen

(10) Patent No.: US 9,679,680 B1
(45) Date of Patent: Jun. 13, 2017

(54) EXTENSION CORD WITH GRADUATED COLORS AND INDICATORS

(71) Applicant: John Cohen, Fort Worth, TX (US)

(72) Inventor: John Cohen, Fort Worth, TX (US)

( * ) Notice: Subject to any disclaimer, the term of this patent is extended or adjusted under 35 U.S.C. 154(b) by 81 days.

(21) Appl. No.: 14/714,945

(22) Filed: May 18, 2015

(51) Int. Cl.
*H01B 7/36* (2006.01)

(52) U.S. Cl.
CPC ..... *H01B 7/365* (2013.01)

(58) Field of Classification Search
CPC ..... H01B 7/365; H01B 7/36; H01B 7/361
See application file for complete search history.

(56) References Cited

U.S. PATENT DOCUMENTS

2004/0020684 A1* 2/2004 Yueh ..... H01B 7/36
174/135

* cited by examiner

*Primary Examiner* — David V Bruce
(74) *Attorney, Agent, or Firm* — James E. Walton

(57) ABSTRACT

A system and method for assisting users of electrical extensions cords to detangle the cords as quickly and efficiently as possible. The improved extension cords features markings on regions of the cord to assist the user in locating the part or section of the cord associated with a single end.

15 Claims, 4 Drawing Sheets

EXTENSION CORD WITH GRADUATED COLORS AND INDICATORS

BACKGROUND

1. Field of the Invention

The present invention relates in general to the field of electrical extension cords and various methods of designing extensions cords to facilitate de-tangling them.

2. Description of Related Art

Electrical extension cords are notorious for becoming tangled. There are many devices out on the market for preventing tangled cords such as cord winders and hoops to wrap the cord around. These devices do not facilitate the detangling of the cord once the cord has become tangled. Users require that the cord be detangled before use in order to maximize the useful length of the extension cord.

Referring to FIG. 1 in the drawings, a prior art embodiment of a typical tangled extension cord according to the present application is illustrated. Cord 101 is tangled and the user will spend considerable time straightening the cord for use. The user cannot readily determine the middle of the cord or what part of the extension cord goes with either end of the cord. While there are many ways to mark extension cords known in the art, considerable room for improvement remains.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
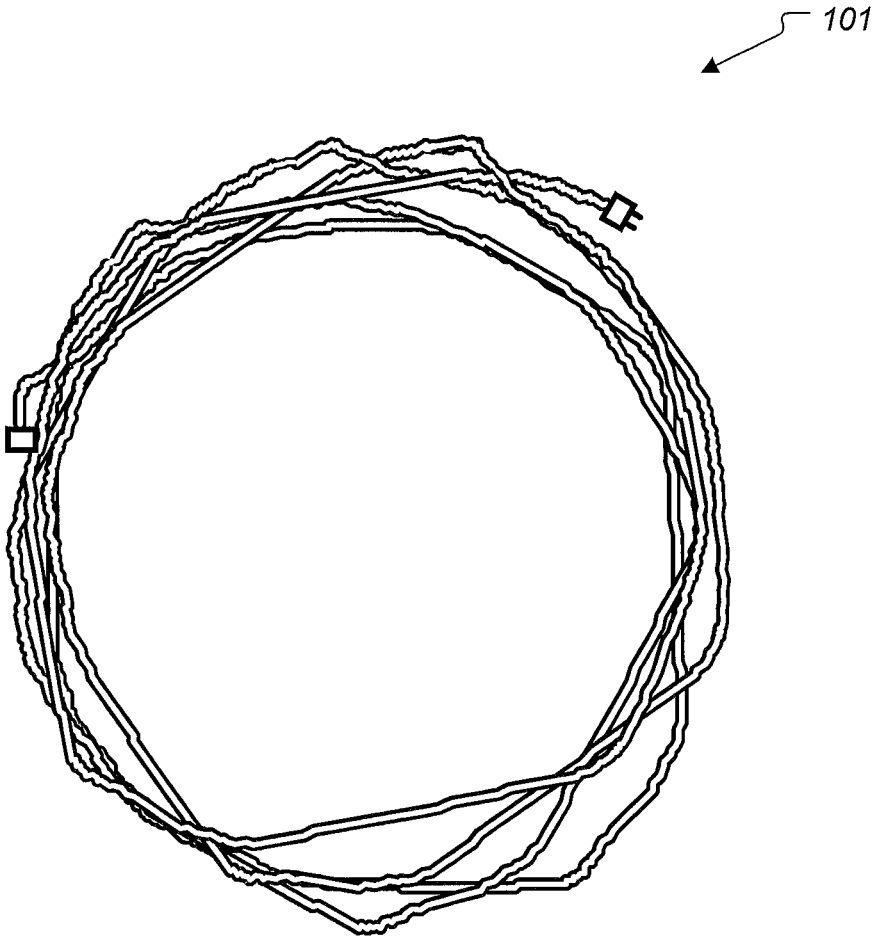
FIG. 1 Prior Art
FIG. 1 is a plan view of a prior art example of a tangled extension cord according to the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of an extension cord with graduated colors and indicators are provided below. It will of course be appreciated that in the development of any actual embodiment, numerous implementation-specific decisions will be made to achieve the developer's specific goals, such as compliance with assembly-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Typically a user in detangling an extension cord finds an end and starts pulling that end out of the tangle. Because the cord is uniformly colored along the entire end of the cord it is difficult for the user to find the next section of cord in the tangled nest of cord to then pull out of the tangle. Furthermore, when extension cords are knotted along with being tangled it is very difficult to easily discern which part of the cord the user should pull on to detangle and unknot.

Figure 2:
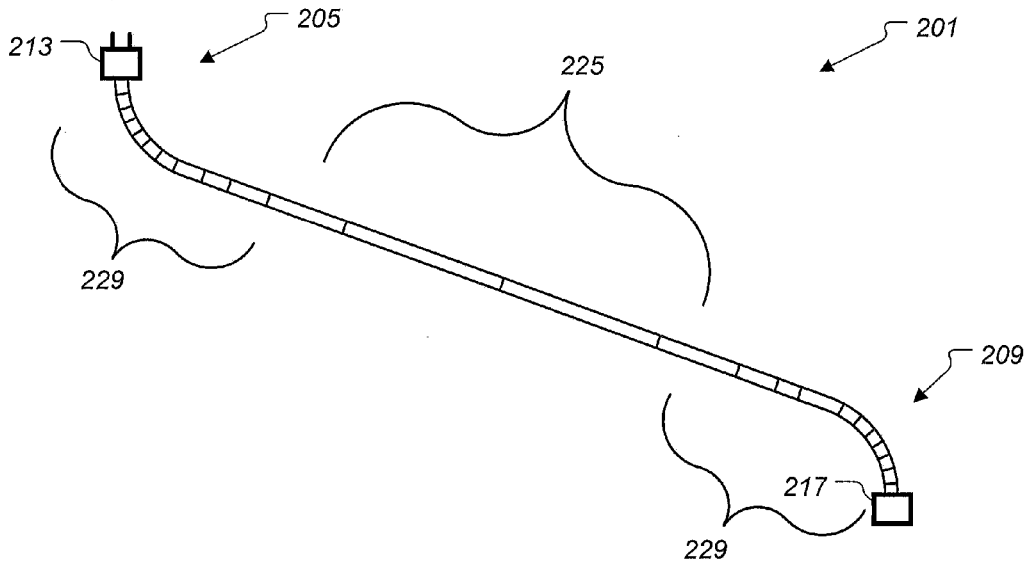
FIG. 2 is a plan view of an extension cord with graduated colors and indicators according to the present application.

Referring now also to FIG. 2 in the drawings, an embodiment of an extension cord with graduated colors and indicators according to the present application is illustrated. Extension cord 201 includes a first end 205 and a second end 209. Located on the first end 205 is a male plug 213 or input connector adapted to connect to wall outlet. Located on the second end 209 is a female plug 217 or output connector adapted to connect to a powered device like a drill. Between the first end 205 and the second end 209 is a cable having at least one electrically conductive path. Extension cord 201 is configured to allow a user to plug the cord into a standard 120 v outlet and then remotely provide power to a 120 v device, such as a drill, at a length away from the standard 120 v outlet. Typical lengths of the cord 201 range from 1 ft to over 100 ft depending upon the needs of the user.

Cord 201 includes a series of marks or markings arrayed along the length of the cord. The distance between marks is varied along the length of the cord. As shown, the distance between marks is greatest in the middle region, middle portion 225, or central section of cord 201. In contrast the distance between marks is narrowest in the end regions 229. The distance between marks decreases from a maximum at the center of the cord to a minimum at the ends of the cord. These marks allow a user to easily detect where the center of the cord 201 is and then work outwardly towards one end.

The marks are preferably rings of color in a contrast to the color of the cord itself, the rings are visible from all angles. The marks could be tape applied after manufacturing of the cord. The marks could be engraved into the cord or molded onto the cord. Furthermore, the marks could be colored differently along the length of the cord. For example, one end of marks could be yellow and the other end of marks blue with a transition to green marks in the middle of the cord thereby the color of the markings varies in relation to the distance between the mark and the end of the cord.

Figure 3:
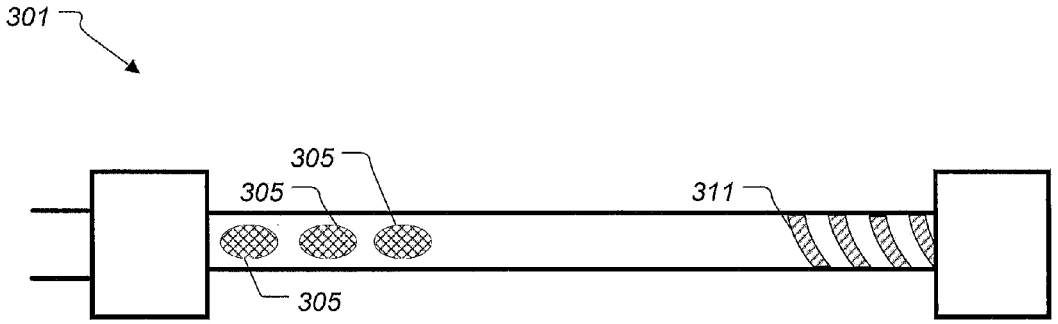
FIG. 3 is a plan view of an extension cord with graduated colors and patterns according to the present application.

Referring now also to FIG. 3 in the drawings, an alternative embodiment of an extension cord with graduated colors and indicators according to the present application is illustrated. Cord 301 includes a first series of patterned marks 305 having a first color adjacent a first end. Cord 301 includes a second series of patterned mark 311 having a second color adjacent a second end. Adjacent an end is understood to be located between the end of the extension cord and the center of the extension cord. Patterned mark 311 is a spiral strip around the cord. It should be apparent that a width between spirals can be varied along the length to indicate position along the cord 301. Additionally, a third series of patterned marks having a third color located in the middle region is contemplated. Using a first set of marks with a first shape and a second set of marks with a second shape that is different from the first shape allows users to easily ascertain the cord adjacent an end.

Figure 4:
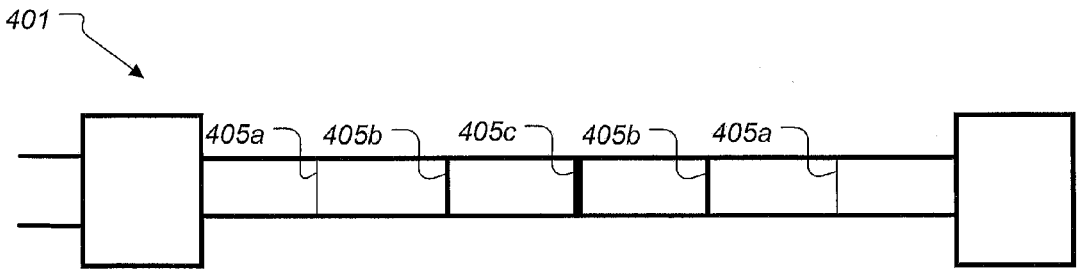
FIG. 4 is a plan view of an extension cord with graduated colors and indicators according to the present application.

Referring now also to FIG. 4 in the drawings, an alternative embodiment of an extension cord with graduated colors and indicators according to the present application is illustrated. Cord 401 includes a series of marks 405 regularly spaced along a length of cord 401. Marks 405*a* have a small width and are located closest to the ends of the cord 401. Marks 405*b* have a width greater than marks 405*a* and are located between marks 405*a*. Mark 405*c* has the greatest width and is located in the center of the cord 401. The distance between the centerlines of marks 405 are spaced an equal distance apart, such as a foot, to allow a user to use the cord to measure distances with the extension cord.

Figure 5:
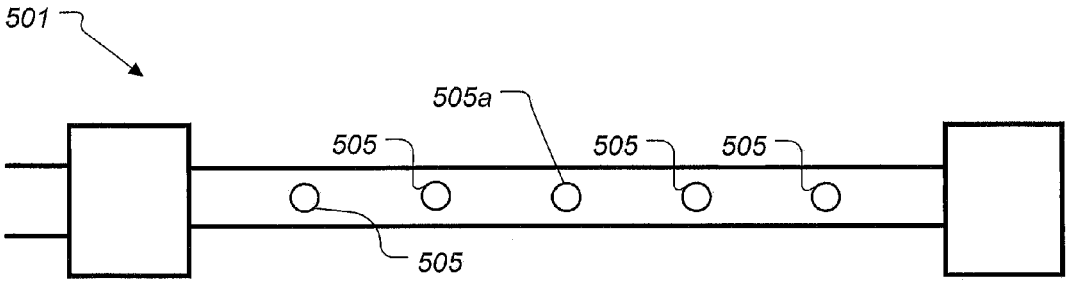
FIG. 5 is a plan view of an extension cord with graduated colors and indicators according to the present application.

Referring now also to FIG. 5 in the drawings, an alternative embodiment of an extension cord with graduated colors and indicators according to the present application is illustrated. Cord 501 includes a series of spaced light sources 505 along the length of the cord. Light source 505*a* is the center of the cord and is preferably colored differently from the rest of the light sources. Light sources 505 like the previously described marks can be selectively spaced along the length of cord 501 to indicate relative position.

Light sources 505 are preferably light emitting diodes but other devices are contemplated by this application such as incandescent bulbs, cathode tubes, and fluorescent bulbs. Light sources 505 are capable of being cycled on and off in a pattern to aid the user in detangling the cord. For example, the light sources nearest the ends blink faster than those near the center of the cord. Additionally, the intensity of the lighting elements can be varied along the length of the cord. This allows the user to find an end of the extension cord.

Figure 6:
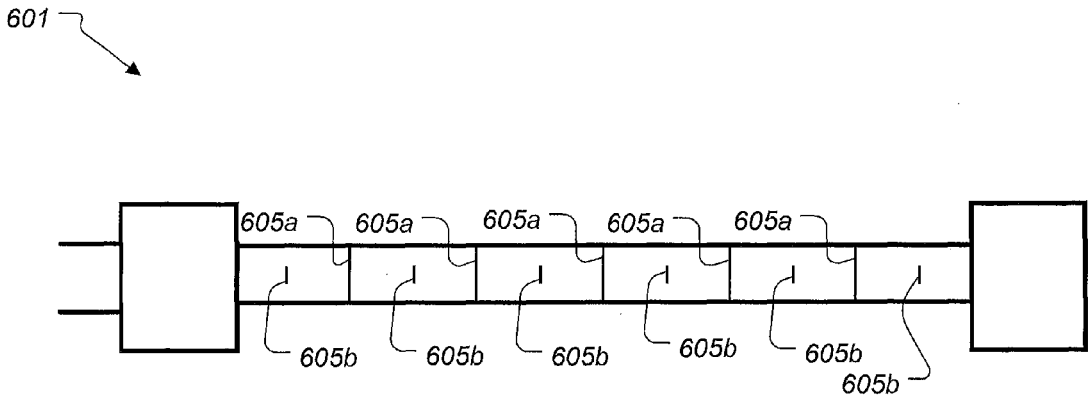
FIG. 6 is a plan view of an extension cord with graduated colors and indicators according to the present application.

Referring now also to FIG. 6 in the drawings, an alternative embodiment of an extension cord with graduated colors and indicators according to the present application is illustrated. Cord 601 features a pattern of major marks 605*a* and minor marks 605*b*. The preferred distance between major marks is one foot and the preferred distance between major marks 605*a* and minor marks 605*b* is six inches. Other patterns and distances are contemplated by this application, such as having eleven minor marks between a pair of major marks. Users of cord 601 can measure the length of items by placing the cord 601 adjacent to the item to be measured and counting the major and minor marks to determine a length of the item.

Figure 7:
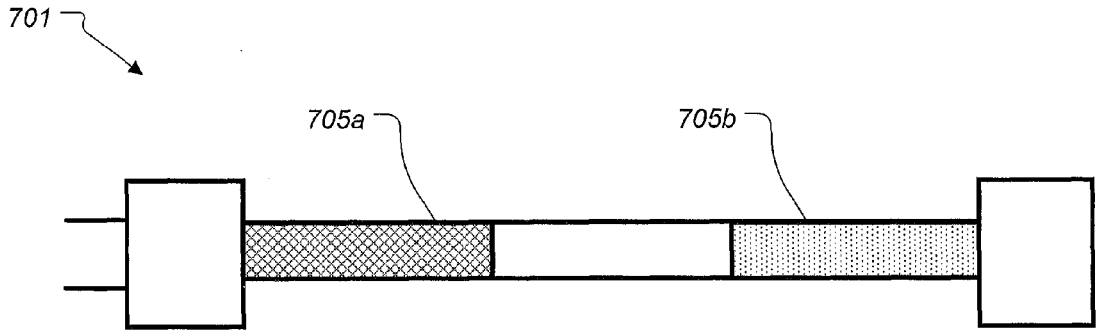
FIG. 7 is a plan view of an extension cord with graduated colors and indicators according to the present application.

Referring now also to FIG. 7 in the drawings, an alternative embodiment of an extension cord with graduated colors and indicators according to the present application is illustrated. Cord 701 features a first colored region 705*a* and a second colored region 705*b*. Both the first colored region and the second colored region are colors different than center of the cord 701 and are each different colors. Additionally, the color of the first colored region 705*a* and second colored region 705*b* can be graduated by shades such that the color nearest the plug is darker than nearest the center of the cord 701. This tri-colored allows a user to quickly select a certain end or the middle of the cord.

It is apparent that a system and method with significant advantages has been described and illustrated. The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. An extension cord, comprising:
- a first end;
- a second end;
- a first plurality of markings located adjacent the first end; and
- a second plurality of markings located adjacent the second end.

2. The extension cord according to claim 1, further comprising:
- a middle portion located between the first end and the second end; and
- a third plurality of markings located in the middle portion.

3. The extension cord according to claim 2, wherein a color of the first plurality of markings varies in relation to a distance between the marking and the first end.

4. The extension cord according to claim 1, wherein a shape of the first plurality of markings is different than a shape of the second plurality of markings.

5. The extension cord according to claim 2, wherein a width of each marking in the first plurality of markings varies in relation to a distance between the marking and the first end.

6. The extension cord according to claim 2, wherein a distance between each marking in the first plurality of markings varies in relation to a distance between the marking and the first end.

7. The extension cord according to claim 1, wherein the first plurality of markings are colored rings around the extension cord.

8. The extension cord according to claim 1, wherein the first plurality of marks are light emitting diodes.

9. An extension cord, comprising:
- a first connector adapted to connect to an input;
- a second connector adapted to connect to an output;
- a cable extending from the first connector to the second connector;
- the cable having at least one electrically conductive path extending from the first connector to the second connector;
- the cable having a central section between the first connector and the second connector;
- the cable having a input section between the first connector and the central section; and
- a first plurality of marks located in the input section;
- wherein a spacing between the first plurality of marks is varied in relation to a distance from the first connector.

10. The extension cord according to claim 9, further comprising:
- the cable having an output section between the second connector and the central section; and
- a second plurality of marks located in the output section.

11. The extension cord according to claim 10, wherein a shape of the first plurality of marks is different than a shape of the second plurality of marks.

12. An extension cord, comprising:
- a first connector adapted to connect to an input;
- a second connector adapted to connect to an output;
- a cable extending from the first connector to the second connector;

the cable having at least one electrically conductive path extending from the first connector to the second connector; and a first plurality of marks located on the cable;

wherein a width of each mark in the first plurality of marks is varied along a length of the cable.

13. The extension cord according to claim 12, wherein the first plurality of marks are light sources.

14. The extension cord according to claim 12, further comprising:

a second plurality of marks located on the cable;

wherein a spacing between each mark in the first plurality of marks is a foot in length; and wherein a spacing between each mark in the second plurality is an inch in length.

15. The extension cord according to claim 12, wherein a color of the first plurality of marks varies in relation to a distance from the first connector.

* * * * *